US007275311B2

(12) United States Patent
Markevitch et al.

(10) Patent No.: US 7,275,311 B2
(45) Date of Patent: Oct. 2, 2007

(54) APPARATUS AND SYSTEM FOR PRECISE LAPPING OF RECESSED AND PROTRUDING ELEMENTS IN A WORKPIECE

(75) Inventors: Yuri Markevitch, San Jose, CA (US); Mark C. McMaster, Menlo Park, CA (US); Yu-En Percy Chang, Mountain View, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 242 days.

(21) Appl. No.: 11/140,445

(22) Filed: May 27, 2005

(65) Prior Publication Data

US 2005/0217106 A1 Oct. 6, 2005

Related U.S. Application Data

(62) Division of application No. 09/709,854, filed on Nov. 10, 2000, now Pat. No. 6,935,013.

(51) Int. Cl.
*B23P 19/00* (2006.01)
*G11C 5/12* (2006.01)

(52) U.S. Cl. ..... 29/737; 29/603.12; 29/603.13; 29/603.16; 29/603.18; 29/729; 216/88; 216/89; 438/692; 438/693; 451/5; 451/28; 451/41; 451/527; 451/530

(58) Field of Classification Search ..... 29/603.12, 29/603.15–603.16, 603.18, 729, 737; 451/5, 451/28, 41, 527, 530; 216/88, 89; 438/692, 438/693

See application file for complete search history.

(56) References Cited

U.S. PATENT DOCUMENTS 5,968,238 A * 10/1999 Healy et al. ..... 106/3
5,981,396 A * 11/1999 Robinson et al. ..... 438/692

(Continued)

FOREIGN PATENT DOCUMENTS

JP 402075780 A 3/1990

OTHER PUBLICATIONS

Guzzo et al., "Effect of Crystal Orientation on Lapping and Polishing Processes of Natural Quartz", IEEE Transactions on Ultrasonics, Ferroelectrics, and Frequency Control, Sep. 2000, pp. 1217-1227, vol. 47, No. 5.

*Primary Examiner*—Paul D. Kim
(74) *Attorney, Agent, or Firm*—Duke Amaniampong; Dillon & Yudell LLP

(57) ABSTRACT

An apparatus and system for precise lapping of recessed and protruding elements in a workpiece is disclosed. According to one embodiment, a system is provided having an air bearing surface with electrical components embedded therein to provide a desired surface dimension thereof. The described system embodiment comprises a non-abrasive lapping plate having a lapping surface with a plurality of grooves therein, a support structure for supporting a workpiece such that an air bearing surface thereof is exposed, and a non-abrasive liquid. When the non-abrasive liquid is dispensed between the air bearing surface and the lapping plate, the lapping plate contacts the air bearing surface such that the air bearing surface is lapped solely by the grooves in the lapping plate. The electrical components of the air bearing surface are lapped such that they are substantially uniform in dimension relative to the air bearing surface.

4 Claims, 3 Drawing Sheets

U.S. PATENT DOCUMENTS 6,050,879 A * 4/2000 Dubrovskiy et al. ..... 451/36
6,383,239 B1 * 5/2002 Suzuki et al. ..... 51/307
6,444,132 B1 * 9/2002 Orii et al. ..... 216/22

* cited by examiner

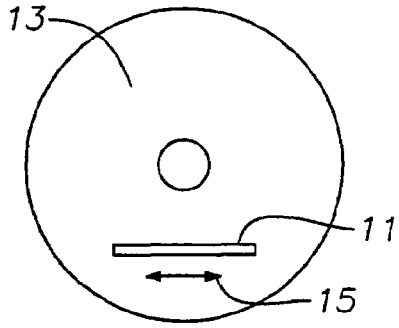
Fig. 1
(Prior Art)
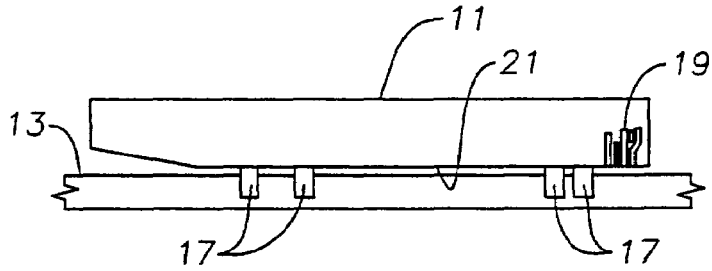
Fig. 2
(Prior Art)
Fig. 3
(Prior Art)
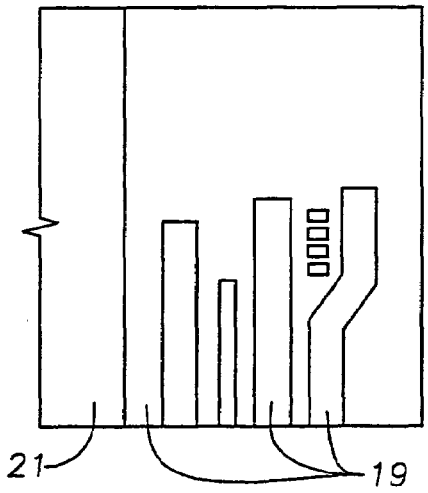
Fig. 4
(Prior Art)
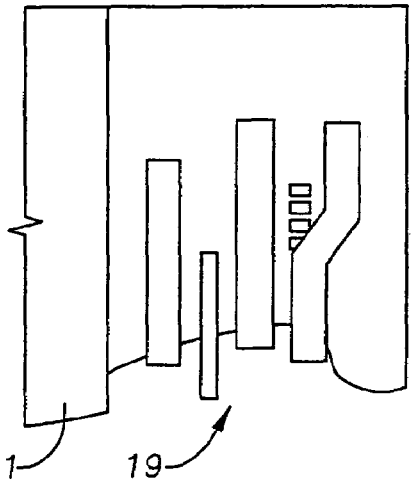
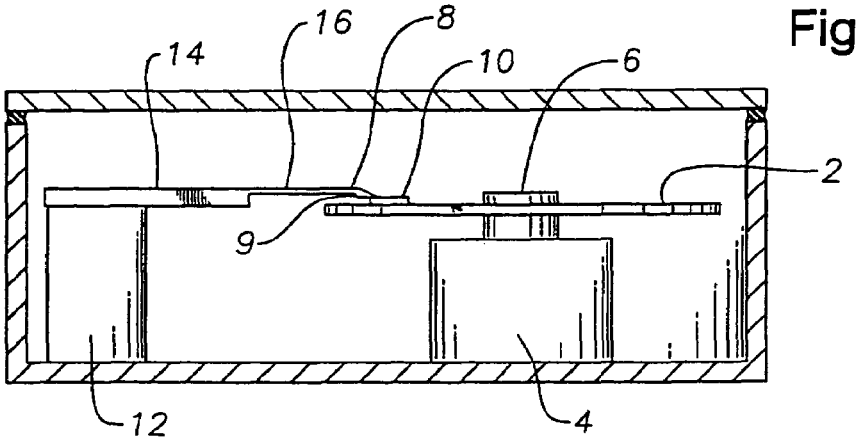
Fig. 5

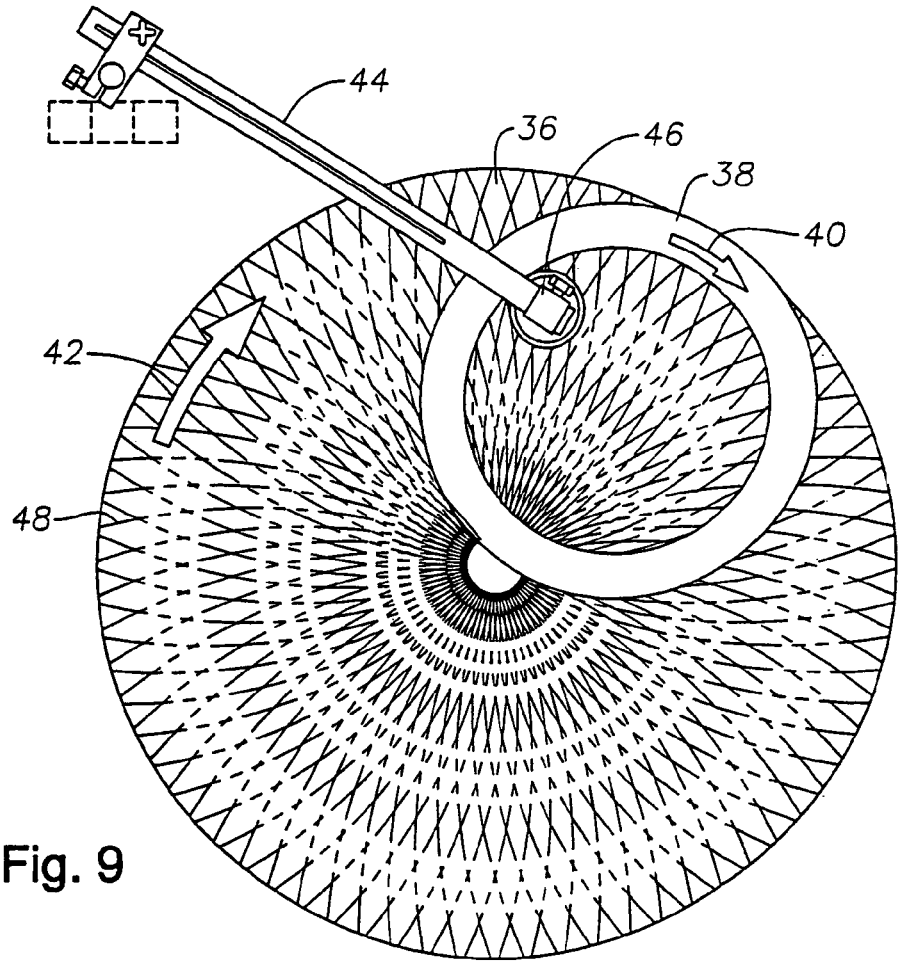
Fig. 9
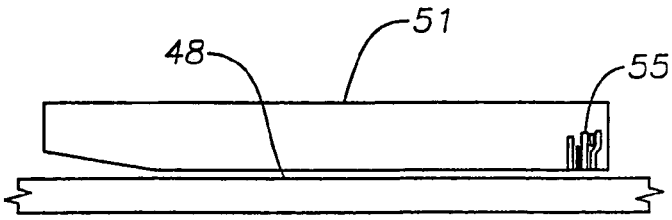
Fig. 10
Fig. 11
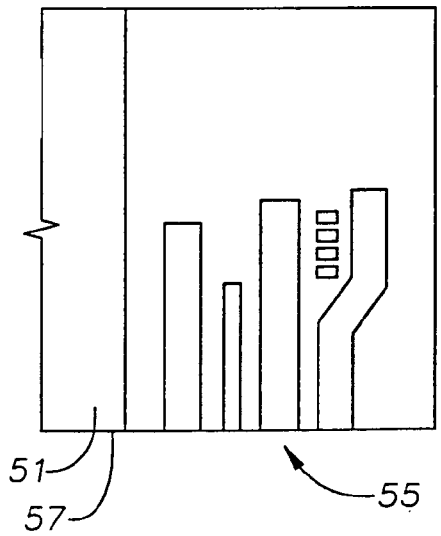

APPARATUS AND SYSTEM FOR PRECISE LAPPING OF RECESSED AND PROTRUDING ELEMENTS IN A WORKPIECE

CROSS-REFERENCE TO RELATED APPLICATIONS

The present application is a divisional of U.S. patent application Ser. No. 09/709,854, filed on Nov. 10, 2000 now U.S. Pat. No. 6,935,013. Applicants hereby claim benefit of priority under 35 U.S.C. §120 to U.S. patent application Ser. No. 09/709,854, which is incorporated by reference herein in its entirety and for all purposes.

BACKGROUND OF THE INVENTION

1. Technical Field

The present invention relates in general to lapping workpieces, and in particular to improving the precision of a lapping process for magnetic transducers. Still more particularly, the present invention relates to a precisely controlling lapping of a workpiece having an element that is recessed in or protruding from the lapped surface of the air bearing surfaces of magnetic transducers.

2. Description of the Prior Art

Magnetic recording is employed for large memory capacity requirements in high speed data processing systems. For example, in magnetic disc drive systems, data is read from and written to magnetic recording media utilizing magnetic transducers commonly referred to as magnetic heads. Typically, one or more magnetic recording discs are mounted on a spindle such that the disc can rotate to permit the magnetic head mounted on a moveable arm in position closely adjacent to the disc surface to read or write information thereon.

During operation of the disc drive system, an actuator mechanism moves the magnetic transducer to a desired radial position on the surface of the rotating disc where the head electromagnetically reads or writes data. Usually the head is integrally mounted in a carrier or support referred to as a "slider." A slider generally serves to mechanically support the head and any electrical connections between the head and the rest of the disc drive system. The slider is aerodynamically shaped to slide over moving air and therefore to maintain a uniform distance from the surface of the rotating disc thereby preventing the head from undesirably contacting the disc.

Typically, a slider is formed with two parallel rails having a recessed area between the rails and with each rail having a ramp at one end. The surface of each rail that glides over the disc surface during operation is known as the air bearing surface. Large numbers of sliders are fabricated from a single wafer having rows of the magnetic transducers deposited simultaneously on the wafer surface using semiconductor-type process methods. After deposition of the heads is complete, single-row bars 11 (see FIG. 1) are sliced from the wafer, each bar comprising a row of units which can be further processed into sliders having one or more magnetic transducers on their end faces. Each row bar is bonded to a fixture or tool where the bar is processed and then further diced, i.e., separated into sliders having one or more magnetic transducers on their end faces.

The slider head is typically an inductive electromagnetic device including magnetic pole pieces which read the data from or write the data onto the recording media surface. In other applications the magnetic head may include a magneto resistive read element for separately reading the recorded data with the inductive heads serving only to write the data. In either application, the various elements terminate on the air earing surface and function to electromagnetically interact with the data contained on the magnetic recording disc. In order to achieve maximum efficiency from the magnetic heads, the sensing elements must have precision dimensional relationships to each other as well as the application of the slider air bearing surface to the magnetic recording disc. During manufacturing, it is most critical to grind or lap these elements to very close tolerances of desired thickness in order to achieve the unimpaired functionality required of sliders.

Conventional lapping processes utilize either oscillatory or rotary motion of the workpiece across either a rotating or oscillating lapping plate 13 (FIG. 1) to provide a random motion of the workpiece 11 over lapping plate 13 and randomize plate imperfections across the head surface in the course of lapping. During the lapping process, the motion 15 of abrasive particles 17 (FIGS. 2 and 3) carried on the surface of the lapping plate 13 is typically transverse to or across the magnetic head elements 19 exposed at the slider air bearing surface 21. In magnetic head applications, the electrically active components 19 exposed at the air bearing surface are made of relatively softer, ductile materials. These electrically active components during lapping can scratch and smear into the other components causing electrical shorts and degraded head performance. The prior art lapping processes cause different materials exposed at the slider air bearing surface 21 to lap to different depths (FIG. 4), resulting in recession or protrusion of the critical head elements 19 relative to the air bearing surface 21. As a result, poor head performance because of increase space in between the critical elements and the recording disc can occur.

Rotating lapping plates having horizontal lapping surfaces in which abrasive particles such as diamond fragments are embedded have been used for lapping and polishing purposes in the high precision lapping of magnetic transducing heads. Generally in these lapping processes, an abrasive slurry utilizing a liquid carrier containing diamond fragments or other abrasive particles is applied to the lapping surface as the lapping plate is rotated relative to the slider or sliders maintained against the lapping surface. Common practice is to periodically refurbish the lapping plate with a lapping abrasion to produce a surface texture suitable for the embedding and retention of the appropriate size of diamond abrasive being used with the lapping process. One of several problems experienced is that the surface is susceptible to rapid change in smoothness as it is used to lap a workpiece during lapping. A change in smoothness effects the hydrodynamic bearing film provided by the liquid component of the abrasive slurry creating a hydroplaning effect which raises the workpiece from the lapping surface to diminish the abrasion action of the particles and substantially increases abrasion time required.

The general idea of interrupting the lapping surface, for example, by forming grooves in the lapping plate is known in the art. Further, material has been used in the troughs so that unspent abrasive liquid is maintained adjacent to the working surface of the lapping plate while spent abrasive fluid is centrifugally removed beyond the lap plate peripheral. In other applications, the grooves are formed between working surface area in which an abrasive such as diamond particles are embedded in a metallic coat.

Problems exist with grooved plates such as excessive width and/or depth of the grooves to allow abrasive particles to lose their effectiveness due to lack of contact with a workpiece. Grooves that are too wide provide surface discontinuity too severe for small work pieces. Forming such grooves is costly and time consuming. Even if the grooves can be sized properly. Substantial segments of the lapping surface remain ungrooved, or alternatively a prohibitively large number of grooves are required. Surface uniformity on a micropore scale suitable for lapping smaller pieces has been achieved only with extreme care. Refurbishment of such sensitive grooving on a lapping surface required renewal of the precision grooves can be time consuming and expensive. Therefore it can be seen that there is a need for precise conditioning and texturing of the plate surfaces of lapping plates in order to maintain surface flatness, waviness, and microprofile of the grooves in the lapping (polishing) plate. It can also be seen that there is a need for machine conditioning of lapping plates with such conditioning and texturing so as to extend the life of lapping plates. In addition, there is a need for enhanced quality of plate surfaces to yield better quality, scratch-free air bearing surfaces or other surfaces which require soft material lapping having a uniformly textured lapping surface amenable to repeat refurbishment.

SUMMARY OF THE INVENTION

An apparatus and system are provided for precise lapping of recessed and protruding elements in a workpiece. According to one embodiment, a system is provided for lapping a workpiece having an air bearing surface with electrical components embedded therein to provide a desired surface dimension thereof. In the described embodiment, such a system comprises a non-abrasive lapping plate having a lapping surface with a plurality of grooves therein, a support structure for supporting a workpiece such that an air bearing surface thereof is exposed, and a non-abrasive liquid. When the non-abrasive liquid is dispensed between the air bearing surface and the lapping plate, the lapping plate contacts the air bearing surface such that the air bearing surface is lapped solely by the grooves in the lapping plate. The electrical components of the air bearing surface are lapped such that they are substantially uniform in dimension relative to the air bearing surface.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

FIG. 1 is a schematic drawing of a prior art lapping plate and work piece.

FIG. 2 is a schematic side view of a prior art lapping process utilizing abrasives.

FIG. 3 is an enlarged sectional side view of a work piece prior to processing by the prior art process of FIG. 2.

FIG. 4 is an enlarged sectional side view of the work piece of FIG. 3 after being processed by the prior art process of FIG. 2.

FIG. 5 is a schematic sectional side view of one embodiment of a magnetic recording disc drive and slider assembly in accordance with the invention.

FIG. 9 is a top view of a conditioning ring in rotating contact with a lapping plate surface for conditioning and texturing the lapping plate surface.

FIG. 10 is a schematic side view of a lapping process performed in accordance with the invention.

FIG. 11 is an enlarged sectional side view of a work piece after being processed by the process of FIG. 10.

DETAILED DESCRIPTION OF THE PREFERRED EMBODIMENT

Figure 6:
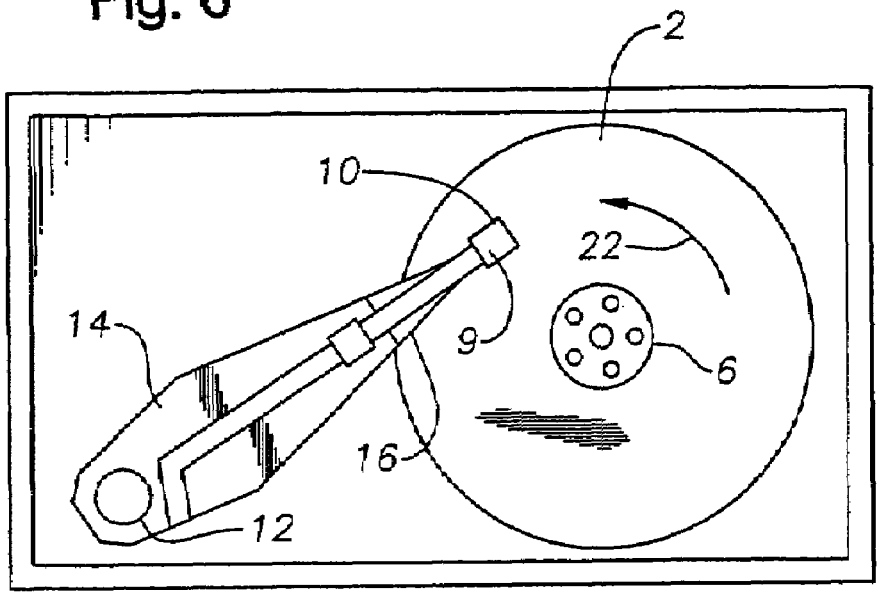
FIG. 6 is a top view of the disc drive of FIG. 5.

Referring to FIGS. 5 and 6, there is shown a magnetic recording disc drive, and a magnetic recording disc 2 rotated by drive motor 4 with a hub 6 which is attached to the drive motor 4. The recording disc 2 comprises a substrate, a metallic magnetic layer, a carbon layer and a polymeric lubricant layer such as perfluoropolyether.

A read/write head or transducer 8 is formed on the trailing end of a carrier, or slider 10. Head 8 may be an inductive read and write transducer, and sliders may be positive or negative air bearing sliders. The slider 10 has a trailing surface 9 and is connected to an actuator 12 by means of a rigid arm 14 and a suspension element 16. The suspension element 16 provides a bias force which urges the slider 10 toward the surface of the recording disc 2. During operation of the disc drive, the drive motor 4 rotates the recording disc 2 at a constant speed in the direction of arrow 22. The actuator 12, which is typically a linear or rotary motion coil motor, drives the slider 10 in a generally radial direction across the plane of the surface of the recording disc 2 so that the read/write head may access different data tracks on recording disc 2.

Disc drive systems are widely used to store data and software for computer systems. A disc drive system generally includes a disc storage media mounted on a spindle such that the disc can be rotated, thereby permitting an electronic magnetic head mounted on a moveable arm to read and write information thereon. The electromagnetic head for a disc drive system is usually mounted in a carrier called a slider. The slider serves to support the head and any electrical connections between the head and the rest of the disc drive system. The slider maintains a uniform distance from the surface of the rotating disc to prevent the head from undesirably contacting the disc. This is accomplished by incorporating aerodynamic features into the slider which cause the slider to glide above the disc surface over the moving air. The slider contact surface is finely finished and polished in order to achieve the aerodynamic requirements for utilization in ABS applications. In order to meet increasing demands for more and more data storage capacity, slider fabrication and ABS surface finishing must be improved. Lapping and polishing methodology as well as the texturing, conditioning, and refurbishing of lapping plates surface must be developed which enhance lapping processability of air bearing surface features.

Figure 7:
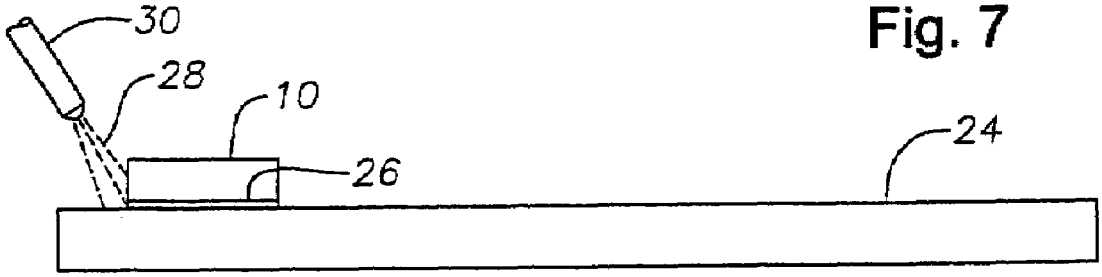
FIG. 7 is a schematic drawing of a lapping plate in lapping contact with an ABS subject surface in accordance with the invention.

The cross-sectional view of FIG. 7 shows the utilization of an improved lapping plate 24, in lapping contact with a slider ABS surface 26. The lapping process utilizes an abrasive-free slurry 28 comprising various fluid elements including ethylene glycol and sodium citrate. The glycols provide lubrication for the lapping process while the sodium citrate materials provide a surfactant effect which enhances the lubrication characteristics of the glycols. Slurry 28 is preferably provided through a spray nozzle 30 connected to and sourced by a free mixed slurry container (not shown).

Figure 8:
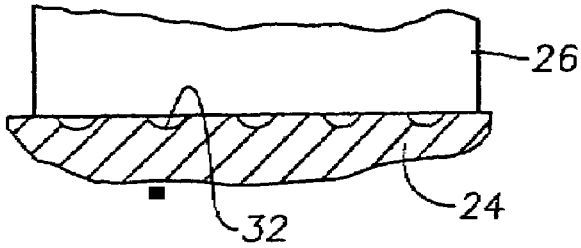
FIG. 8 is an enlarged sectional side view of the lapping plate and ABS of FIG. 7 illustrating grooves in the ABS.

FIG. 8 is an enlarged cross-sectional view of the area of lapping contact of the lapping plate 24 and slider ABS surface 26. The enlarged side view presents the lapping plate 24 having grooves 32 for providing quality lapped ABS surfaces which are substantially scratch free.

The top view of FIG. 9 shows a lapping plate 36 contacted by a conditioning ring 38 with the relative rotational kinetics of the conditioning ring shown by arrow 40 and the lapping plate rotational direction shown by arrow 42. The conditioning ring 38 is positioned by lever arm 44 having a drive head 46 for producing the rotation of the conditioning ring 38. The lapping plate 36 shows various grooves formed in configurations of pericycloids, epicycloids, hypocycloids, and circles 48. The conditioning ring 38 has an embedded diamond layer or other hard abrasive particles held by hard bound materials such as nickel-plating or similar surfaces so that the particles cannot be removed from the ring during the conditioning process.

In the prior art, lapping plates incorporated grooves formed between the working surface areas in which an abrasive such as diamond particles was embedded in a metallic coat. The grooves were utilized to sweep beneath the work pieces to remove abrasive particles as the abrasive disc rotated. Problems with such grooved lapping plates include excessive width and depth of grooves or uncontrolled groove dimensions which allow the abrasive particles if presented in a slurry to locate in such excessive groves and lose their functionality for further abrasive action. Further, these undesired, oversized grooves provide a surface discontinuity that is too severe for small work pieces. Refurbishment of these lapping surfaces required removal of the old grooves and then forming new grooves in them, which requires additional time and expense.

In addition to designed groove geometry, the number of grooves on the lapping plate surface can provide a high percentage of lapping surface engagement. The lapping plate surface grooves interrupt the planarity of the lapping surface to reduce the hydrodynamic film from the slurry, thereby permitting the work piece to interact more intimately with the lapping plate. This feature substantially reduces hydroplaning. The result of the precision grooving is increased lapping rates, particularly as compared to the expected rate for a similar area provided with grooves having undesired geometry.

The lapping plate is rotated from about 20 to about 100 RPMs with the conditioning ring rotating in the same direction of rotation as that of the lapping plate, but only at about 0.5 to about 0.9 of the RPMs of the lapping plate. Pressure contact of the conditioning ring with the lapping plate ranges from about 2 to about 15 psi with the conditioning ring containing abrasive particles such as diamond particles of about 80 to 320 micron particle size with about 160 microns as an average working particle abrasive size. Kinetics of the lapping plate and conditioning ring relationship provide geometry and severity of the grooves including peaks to valleys. These lapping plates are suitable for lapping polishing slider ABS surfaces and any other surface requiring precision lapping and polishing utilizing a soft material lapping plate. During the conditioning and texturing of the lapping plate, the abrasive particles utilized by the conditioning ring are hard mounted in materials which do not release the particles. Thus, the process produces lapping plate grooving without any foreign contamination or residue buildup.

The lapping plate is considered a soft lapping plate surface and is comprised of about 97.5 percent tin compounded with various other materials. The textured lapping plate surface is produced with grooves comprising approximately 0 to 5% of the lapping plate surface. Various grooved profiles are generated by the relative RPM motions of the lapping plate and conditioning ring. The grooves have different angles of grain attached which produce and control relative direction of lapping when utilizing the lapping plate surface against a subject surface to be lapped and polished.

Referring now to FIGS. 10 and 11, a lapping process utilizing oscillatory or rotary motion of a slider body or workpiece 51 across either a rotating or oscillating lapping plate 36 provides a random motion of workpiece 51 relative to lapping plate 36, and randomizes plate imperfections across the head surface of work piece 51 during the course of lapping. During the lapping process, work piece 51 is supported such that its air bearing surface 57 is exposed. The motion of the grooved, non-abrasive lapping plate 36 is typically transverse to or across the magnetic head elements 55 embedded in and exposed at the slider air bearing surface 57. A non-abrasive liquid or slurry is dispensed between lapping plate 36 and air bearing surface 57. In magnetic head applications, the electrical components 55 exposed at air bearing surface 57 are made of relatively softer, ductile materials. However, without the presence of abrasive particles either in lapping plate 36 or in the liquid between lapping plate 36 and work piece 51, the electrically active components 55 are not scratched or smeared into the other components during lapping. Instead, components 55 are lapped such that they are substantially uniform in dimension relative to the air bearing surface 57, as shown in FIG. 11. Since there are no abrasive particles present, air bearing surface 57 is lapped solely by grooves 48. After lapping and/or polishing, a protective coating may be subsequently applied to air bearing surface 57.

The invention has several advantages including the ability to allow various recession/protrusion targets to be precisely lapped with improved surface finish and poletip/sensor cleanness. No abrasive particles are used for material removal during the critical step of the process. Since the lapping plate is harder than the targets but softer than the ABS itself, it is the microtexture of the lapping plate that removes material form the target, and not from the ABS. The lapping plates may be selected to target various elements of the workpiece including the substrate, poletips, and alumina undercoat or overcoat. Thus, processing work pieces in accordance with the present invention avoids electrical shorts and degraded head performance.

While the invention has been shown or described in only some of its forms, it should be apparent to those skilled in the art that it is not so limited, but is susceptible to various changes without departing from the scope of the invention.

What is claimed is:

1. A system for lapping a workpiece having an air bearing surface with electrical components embedded therein to provide a desired surface dimension thereof, comprising:

a non-abrasive lapping plate having a lapping surface with a plurality of grooves therein;

a support structure for supporting a workpiece such that an air bearing surface thereof is exposed;

a non-abrasive liquid; and wherein when the non-abrasive liquid is dispensed between the air bearing surface and the lapping plate, the lapping plate contacts the air bearing surface such that the air bearing surface is lapped solely by the grooves in the lapping plate, and wherein the electrical components of the air bearing surface are lapped such that they are substantially uniform in dimension relative to the air bearing surface.

2. The system of claim 1, wherein the grooves in the lapping plate are in configurations of pericycloids, epicycloids, hypocycloids, and circles.

3. The system of claim 1, wherein a planarity of the lapping surface of the lapping plate is interrupted with the grooves such that a high percentage flapping surface engagement is provided by the grooves to reduce a hydrodynamic film from the liquid.

4. The system of claim 1, wherein the grooves comprise approximately 0 to 5% of the lapping surface of the lapping plate.

* * * * *